United States Patent [19]

Inukai et al.

[11] 4,236,485

[45] Dec. 2, 1980

[54] TONER CONCENTRATION CONTROL DEVICE

[75] Inventors: Sumitaka Inukai, Yokohama; Takashi Azuma, Ebina, both of Japan

[73] Assignee: Tokyo Shibaura Denki Kabushiki Kaisha, Kawasaki, Japan

[21] Appl. No.: 63,264

[22] Filed: Aug. 2, 1979

[30] Foreign Application Priority Data

Aug. 2, 1978 [JP] Japan ..... 53-94332

[51] Int. Cl.[3] ..... G03G 15/06; G03G 15/09

[52] U.S. Cl. ..... 118/690; 118/652; 118/658

[58] Field of Search ..... 118/690, 652, 658; 430/122; 355/3 DD

[56] References Cited

U.S. PATENT DOCUMENTS

| | | | |
|---|---|---|---|
| 4,032,227 | 6/1977 | Hubbard et al. | 118/690 |
| 4,064,834 | 12/1977 | Sund | 118/690 |
| 4,112,867 | 9/1978 | Suzuki et al. | 118/690 |
| 4,190,018 | 2/1980 | Ariotti et al. | 118/690 |

*Primary Examiner*—Bernard D. Pianalto

*Attorney, Agent, or Firm*—Oblon, Fisher, Spivak, McClelland & Maier

[57] ABSTRACT

A toner concentration control device comprising a toner supply mechanism for supplying toner to a developing device, conveying means for conveying the developer, detecting means for optically detecting an amount of the toner adhering to a conveying surface of the conveying means and a control mechanism for controlling the toner supply mechanism based on the detected amount of toner. Thus, an amount of fresh toner corresponding to an amount of toner spent by development is supplied from the toner mechanism to a developer in the developing device to maintain a constant toner concentration in the developer.

3 Claims, 7 Drawing Figures

TONER CONCENTRATION CONTROL DEVICE

BACKGROUND OF THE INVENTION

1. Field of the Invention

This invention relates to a toner concentration control device for maintaining a constant toner concentration in a developer of an electrophotographic copying machine.

2. Description of the Prior Art

A developer usually employed for a dry type developing device is a mixture of toner and carrier. The toner is a fine colored resin powder. The carrier consists of particles which are treated so as to attract the toner around them with the aid of the static electricity caused by the friction between the particles and the toner. If, when such a developer is used, the developer toner density is higher than a normal or suitable value, then the amount of floating toner like smoke, not combined with the carrier, is increased. As a result, in the copy of an image, the toner is stuck to portions which should be white, that is, a phenomenon known as "fogging" occurs. On the other hand, the toner is scattered in the developing device to make the latter dirty. If, in contrast, the toner density is decreased, then the density of the reproduced image is decreased as a whole, which leads to incorrect reproduction of the original. Thus, if the toner density is not suitable, then the quality of a copied image is lowered, and not only the service life of the developer but also the service life of the entire device is decreased. These difficulties are well known in the art.

In order to maintain the device as well as the quality of a copied image satisfactorily, it is necessary to complement the amount of toner consumed in copying at required intervals in order to maintain the toner density within a suitable density range.

In order to supply the toner into the developer, means mechanically supplying a predetermined amount of toner at predetermined time intervals is, in general, employed. However, since there are a variety of originals to be copied which are different in the quantity of toner consumption, it is difficult to supplement the amount of consumed toner merely by mechanically supplying the toner. Therefore, the operator of the copying machine operates the dial provided for adjusting the amount of toner supply judging from the state of a copied image, thereby to obtain a copied image which is considered suitable in density. Even if the adjustment dial is operated by the operator, the developer density cannot immediately follow the operation because of the behavior characteristic of the developer. Accordingly, several to several tens of sheets are wasted until a copied image having a desired density is obtained. If the operating procedure of the adjustment dial is improper, then the developer density is greatly shifted from its suitable density range, and not only the copied image but also the entire developing device is adversely affected.

In order to overcome this difficulty and to obtain copied images correct in density at all times, the operator must nervously monitor the density of each copied image and operate the adjustment dial, which makes the operation of the copying machine considerably troublesome and intricate. In order to provide a copying machine which can remove such a burden from the operator, it is necessary to provide a precision toner supplying device which can weigh and supply the amount of toner which has been precisely calculated. However, in this case, the copying machine is necessarily intricate in construction and high in manufacturing cost.

In order to overcome the above-described difficulties, a variety of methods have been proposed in which the toner density is detected by electrical, magnetic or optical means, so that the amount of consumed toner is automatically supplemented to maintain the density correct. However, since the developer employed in the electrophotography special powder, it is considerably difficult to automatically detect the density thereof.

Typically, two density detecting methods utilizing the optical means are known in the art. In one of the two methods the variations in volume of the developer are detected. In the other method the variations in optical reflection or transmission of the developer are detected. In these methods, it is necessary to select developers having characteristics which are suitable for the detection methods. However, the developers thus selected are not always suitable for the object and performance of the copying machine.

Another density detecting method utilizing optical detecting means has been disclosed by Japanese Patent Application Publication No. 46095/1977. In this method, the floating toner of the developer being circulated is allowed to stick to a probe (or a pulley) provided for detecting the density, so that the variation of light quantity attributing to the toner stuck on the probe is detected to obtain the density. However, it has been found as a result of the experiments that the method involves the following facts:

It is considered that one motive power causing the amount of toner proportional to the developer density to stick to the conductive probe attributes to the amount of charge in the toner. If the toner is caused to attach to the probe merely because of the physical property of the toner, then the toner should be similarly attached thereto even if the carrier, the other component of the developer, is changed. The carriers are classified according to the configuration, grain size, electric current value, etc. The curve A in FIG. 1 indicates the relation between the toner density and the amount of attached toner of a developer which includes a typical non-spherical carrier 150–250 meshes in grain size and 73.5 $\mu$A in current value. As the number of chances of rubbing the toner against the carrier is increased, the amount of charges in the toner is increased. The curves $A_O$ and $A_N$ in FIG. 2 indicate the variations of the amount of charges when the use of the above-described developer is started and the variations of the amount of charges after the developer has been used for producing N sheets of copies. In this case, as the developer density is increased, the amount of charges is decreased and the force of combining the toner with the carrier is decreased. Therefore, it can be explained that the toner can readily attach to a member such as the probe when the developer density is increased.

The curve B in FIG. 1 and the curves $B_O$ and $B_N$ in FIG. 2 indicates the relations between the amount of attached toner and the amount of charges in toner obtained when a developer containing the same toner as that in the case of the curve A described above and spherical carrier 100–250 meshes in grain size and 42.8 $\mu$A in current value is employed. In the case of this developer, the amount of charges in the toner is smaller, as a whole, than that in the case of the aforementioned developer and is inversely proportional to the density (in FIG. 2). However, the amount of toner attached to the probe is saturated to the extent that it is substantially difficult to distinguish, with a density of more than 2% (in FIG. 1). More specifically, the amount of charges in the toner when the density of the developer B containing the spherical carrier is at 2% corresponds substantially to that when the density of the developer A containing the non-spherical carrier is at 4%. This coincides with the detector output levels corresponding to the densities 2% and 4% in the curves A and B in FIG. 1. That is, when the toner charge amount is smaller than a certain value, then the amount of toner attached to the probe is saturated, as a result of which the density detection is impossible. In other words, depending on the kind of carrier to be combined with the toner, the toner affects the amount of charges therein. Thus, it can be understood that, in the density detecting method, the lower limit of the toner charge amount of the developer used is high, and the range of use thereof is limited by the characteristic thereof. The toner attaching conditions with respect to the environmental humidity are greatly affected by the humidity characteristic of the toner and by the constructional limitation that the probe must be disposed outside the developer circulating path. Thus, the conditions of use will be further limited.

In the above-described method, the detection may be performed substantially in proportion to the actual density of the developer if the developer and the environmental conditions are suitable. However, as the environmental humidity is changed, the toner attaching condition is greatly affected by the variation in characteristic of the toner with respect to humidity and by the fact that the probe is provided outside the developer circulating path. With a humidity higher than a certain value, the density detecting device according to the method is useless. Similarly as in the above-described two detecting methods, it has been found that the kinds of developers employable for density detection in this method are limited. Furthermore, not only in the described method but also in most of the conventional methods, it is necessary to additionally provide a special device having considerably intricate mechanisms for density detection, with the result that the manufacturing cost is increased. Thus, it has become imperative to improve conventional methods.

SUMMARY OF THE INVENTION

It is accordingly an object of this invention to provide a novel toner control device for a copying machine, which is simple in construction and low in manufacturing cost.

It is a further object to provide a novel toner control device which is, however, able to detect the density of toner with high reliability and thereby to suitably carry out the toner density control.

These and other objects are achieved according to this invention by providing a novel toner concentration control device comprising supplying means for supplying fresh toner to a developing device for causing an electrostatic image on the surface of a photosensitive body to be developed with a developer comprising toner and carrier; conveying means having a conveying surface for conveying the developer through a developing state; detecting means for optically detecting an amount of the toner which separates from the carrier of the developer and attaches to the conveying surface to produce a corresponding signal; and means for controlling the supplying amount of the toner to the developing device based on the signal.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 3:
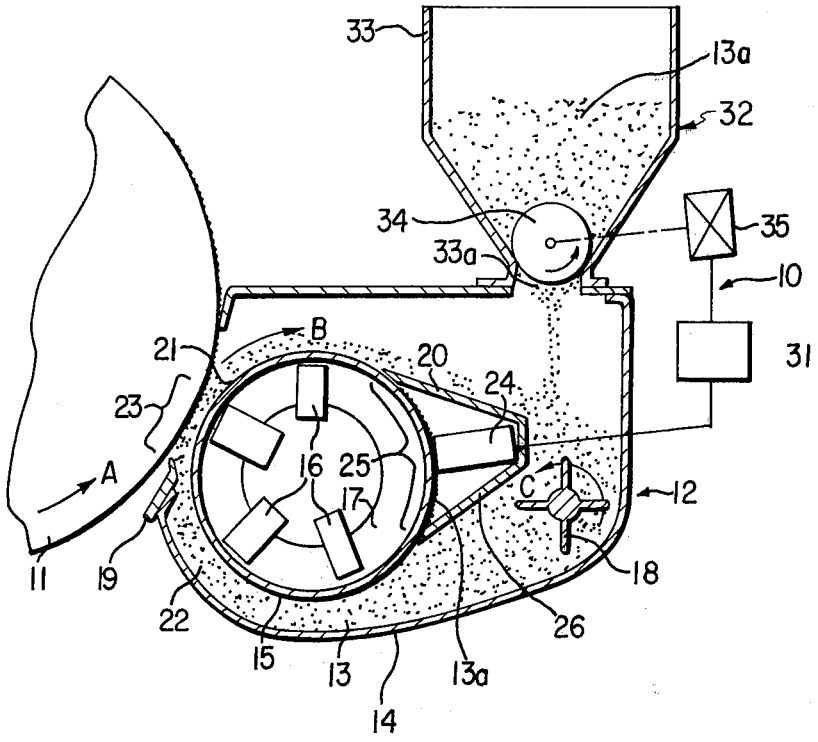
FIG. 3 is a cross-sectional view illustrating a developing mechanism of an electrophotographic copying machine including a toner concentration control device according to this invention.

Referring now to the drawings, wherein like reference numerals designate identical or corresponding parts throughout the several views, and more particularly to FIG. 3 thereof, there is illustrated a developing mechanism of an electrophotographic copying machine incorporating a toner concentration control device 10 according to this invention. Reference numeral 11 is a photosensitive body, such as photosensitive drum, which is rotated in a direction indicated by an arrow A in FIG. 3. An electrostatic latent image is formed by an exposure section (not shown) on the surface of the photosensitive drum 11. Opposed to the drum 11, a developing device 12 has a receptacle 14 in which a developer 13 consisting of a toner and a carrier such as iron powder is received. Within the receptacle 14 a rotary sleeve 15 formed of nonmagnetic material is located near the photosensitive drum and an agitator 18 is positioned to agitate the developer 13. The rotary sleeve 15 is rotated in a direction indicated by an arrow B in FIG. 3 and the agitator is rotated in a direction indicated by an arrow C in FIG. 3. A path for a magnetic brush 21 to be explained later is formed between the rotary sleeve 15 and the receptacle 14. Within the rotary sleeve 15 is disposed a core bar 17 on the outer peripheral surface of which permanent magnets 16 are mounted.

In operation the photosensitive drum 11 bearing an electrostatic latent image and rotary sleeve 15 are rotated, the developer 13 is attracted under the action of the permanent magnets 16 toward the surface of the rotary sleeve 15 and is moved as a magnetic brush 21 in the direction of B in which the sleeve 15 rotated. The magnetic brush 21 passes through the path 22 and regulated by a doctor blade 19 on the base of the receptacle to have a thickness suitable for development. Then the magnetic brush is slidably contacted with the surface of the photosensitive drum 11 to cause the toner in the magnetic brush to be deposited onto the electrostatic latent image on the surface of the photosensitive drum 11. In this way, the developing operation is completed. Thereafter, the magnetic brush on the surface of the rotary sleeve 15 is scraped by a scraper 20 away from the surface of the rotary sleeve 15. The scraper 20 operates to scrape the developer 13 which has passed through a developing region 23 and has not been affected by the upper magnet 16. The scraped developing agent, after being fully agitated by the agitator 18, is again used for a magnetic brush 21.

Figure 4:
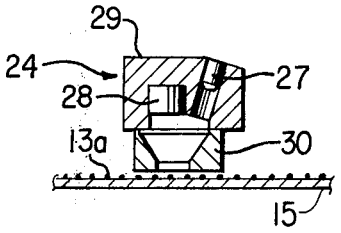
FIG. 4 is also a schematic sectional view illustrating the essential components of the embodiment shown in FIG. 3.

An optical density detector 24 is provided below the scraper 20, to detect the density of the toner on a residual toner attaching region 25 to which only the residual toner 13*a* separated from the carrier on the rotary sleeve 15 is attached. The density detector 24 is surrounded by the scraper 20 and a developer agent guide board 26 integral with the scraper 20, so that the density detector 24 is not affected by the carrier in the developer 13. The density detector 24 is made up of a light emitting unit 27 and a light receiving unit 28 which are held by a holding block 29 integral with a glassed hood 30 to prevent the detector from being made dirty by the smoke-like floating toner, as shown in FIG. 4. The light receiving unit 28 receives light reflected from the surface of rotary sleeve 15 to which is attached toner 13*a*, and converts the received reflected light to a corresponding electrical signal.

The converted electrical signal is supplied to a control mechanism 31. The control mechanism 31 amplifies the above-mentioned electrical signal, compares it with a predetermined reference value to produce a control signal. An amount of fresh toner to be supplied to the developing agent is controlled by the control signal from the control mechanism 31. That is, a hopper 33 is disposed on the control device 10 and has a toner supply opening 33*a* at the bottom thereof. A supply roller 34 blocks the toner supply opening 33*a* of the hopper and feeds a fresh toner 13*a* towards the developing agent in the receptacle when it is rotated by a drive mechanism 35. The hopper 33, supply roller 34 and drive mechanism 35 constitute a toner supply device 32. The drive mechanism 35 and thus the supply roller 34 are controlled by the control signal. By so doing, a fresh toner 13*a* in an amount corresponding to the amount of the toner spent by development is added to the developing agent in the receptacle to maintain the toner concentration in the developing agent 13 always constant.

Now the operation of the above-described embodiment will be described. The developer 13 is attracted in the form of a fur-implanted brush to the region of the surface of the rotary sleeve 15 where the lines of magnetic force are formed by the magnets 16, thus forming a so-called "magnetic brush" 21. As the rotary sleeve 15 rotates, the magnetic brush 21 is rotated. After being set to the predetermined thickness by the doctor blade 19, the magnetic brush 21 is brought into contact with the surface of the photosensitive drum 11. As a result, the static latent image formed in advance on the surface of the photosensitive drum 11 is developed as a toner image; that is, the development is carried out.

The magnetic brush 21 passed through the developing region 23 is scrapped off the surface of the rotary sleeve 15, and is then dropped into the developer accommodating section, where it is agitated by the agitating blade 18. The agitating blade 18 may be made of any of the magnetic, non-magnetic, metallic and non-metallic materials, if it is most suitable for the developing device.

Upon development, the toner 13*a* in the developer 13 is transferred to the photosensitive drum 11, as a result of which the toner density of the developer is reduced; that is, the developer becomes locally non-uniform in toner density. The amount of developer 13 received in the developer accommodating section of the developing device 12 is limited, and the developer 13 is circulated in the bottom 14 for a very short period. Therefore, it is desirable that the reduced density and the non-uniform density are restored to normal before the subsequent cycle is started.

The toner 13*a* separated from the carrier is attached, as a residual toner, to the surface of the rotary sleeve 15 which passed through the scraper 20. As a result of intensive research, it has been found that the amount of toner attached to the residual toner attaching region 25 is proportional to the density of toner.

Figure 5:
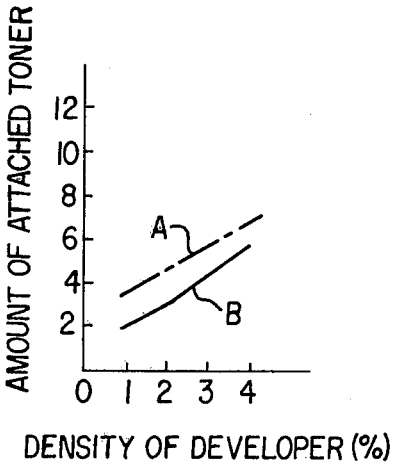
FIG. 5 is a graphical representation indicating the relation between the density of developer and the amount of attached toner in the embodiment shown in FIG. 3.

FIG. 5 is a graphical representation obtained by optically detecting the amount of toner left on the rotary sleeve 15. In FIG. 5, reference characters A and B designate the characteristic curves obtained by using the same developer agents in the previously described system. It has been found that the results of other developer agents also belong to the characteristic curve A or B.

In this experiment, two kinds of rotary sleeves 15 were employed. The surface of one of the two rotary sleeves 15 was not particularly treated; that is, it was flat and smooth. The surface of the other rotary sleeve 15 was blasted with sand of the order of No. 120 into a uniformly roughened surface. The amount of toner stuck to the latter was much larger than the amount of toner attached to the former. FIG. 5 indicates the results of experiments conducted with the latter.

As the surface of the rotary sleeve 15 passes through the region having the lines of magnetic force and the region having no lines of magnetic force, the developer 13 is alternately attracted to the rotary sleeve 15 and scraped off the latter. In addition, the rotary sleeve 15 circulates the developer 13 while slightly sliding along the developer 13 in the case. Accordingly, it can be understood that on the surface of the rotary sleeve 15 also, the residual toner 13*a* attached thereto is attached back to the carrier to clean the surface, and an amount of toner proportional to the density adheres thereto.

Figure 1:
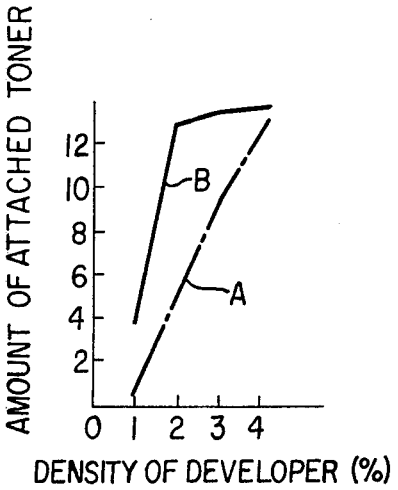
FIG. 1 is a graphical representation indicating the relationship between the density of developer and the amount of attached toner in a conventional probe detection system.
Figure 2:
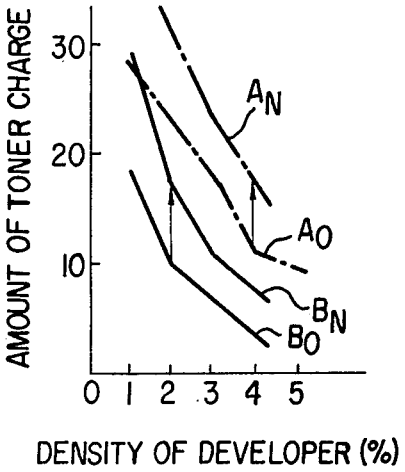
FIG. 2 is a graphical representation indicating the relationship between the density of developer and the amount of toner charge.

The amount of attached toner of the developer A including nonspherical carrier in this detection system is smaller than that in the detection system described with reference to FIG. 1; however, it is sufficient for the determination of the density.

Especially, a remarkable improvement is effected for the developer B including spherical carrier, i.e. the developer 13 small in the amount of toner charge, and the detection can sufficiently cover a range around the actual use density of the developer 13.

That is, even with a developer 13 different in characteristic, the amount of toner corresponding to the density thereof is left on the surface of the rotary sleeve 15, and the limitation in characteristic of the developer 13 employed in this density detection system is eliminated.

As the surface of the rotary sleeve 15 is inside the circulation conveyance path, it is not affected by the environmental conditions; that is, it is under optimum conditions. Thus, it has been found that as the amount of residual toner on the surface of the rotary sleeve 15 is proportional to the density of the developer, it is sufficiently suitable for the density detection.

Referring to FIG. 3, no magnetic pole is provided in the region 25 which is extended from the scraper 20 to the position where the developer 13 is attracted to the rotary sleeve 15. Accordingly, in this region 25, only the residual toner 13*a* separated from the carrier is attached to the surface of the rotary sleeve 15. Thus, the density detection can be carried out in the region 25. The optical density detector 24 is disposed in the region 25.

The magnetic brush 21 is removed by the scraper 20, as a result of which the residual toner 13*a* remains on the surface of the rotary sleeve 15. The light emitting unit 27 of the density detector 24 irradiates a part of the surface of the rotary sleeve 15 in the region 25, and light reflected by the surface of the rotary sleeve 15 thus irradiated is received by the light receiving unit 28. In this case, as the amount of residual toner on the surface of the rotary sleeve 15 is changed in accordance with the developer density, the quantity of received light is changed with the amount of residual toner.

The signal from the light receiving unit 28 is processed by the control mechanism 31. When the density of attached toner is lower than required, then the control mechanism 31 outputs the toner supply signal. In response to the toner supply signal the drive mechanism 35 operates to rotate the supply roller 34, as a result of which the toner 13*a* is dropped into the developer agent receptacle 14.

In the receptacle 14, the developer 13 and the toner 13*a* thus supplied are agitated and mixed to restore the reduced density and the nonuniform density to normal. The mixture is gradually moved toward the rotary sleeve 15 by the circulation action, and then it becomes the magnetic brush 21 again. The amount of toner in one supply is set to a value which is sufficient for copying several to several tens of sheets. As the toner density of the developer 13 is increased, the amount of residual toner 13*a* on the surface of the rotary sleeve 15 is also increased. When it reaches a predetermined density range, then the control mechanism 31 operates to stop the supply of toner.

The toner density of the developer 13 is maintained in the predetermined density range by the density detection, and the supply of toner is augmented in automatic association therewith. Therefore, with the detection and control means of the invention, unlike the conventional one, it is unnecessary for the operator of the copying machine to perform the secondary operation based on the experimental decision. The machine can be readily handled, and is stable in operation.

Figure 6:
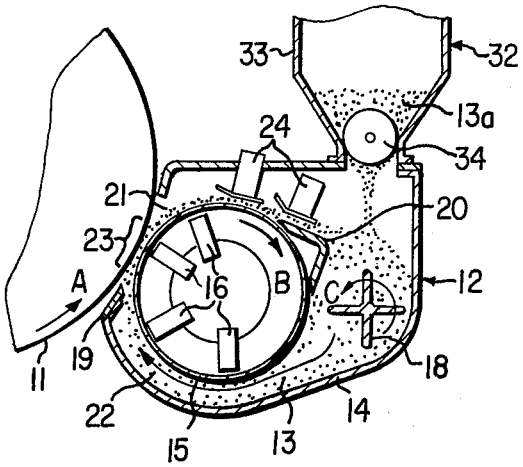
FIGS. 6 and 7 are schematic sectional views illustrating additional embodiments of the invention, respectively.

In the above-described embodiment, the density detector 24 is disposed in the region 25 from the scraper 20 to the position where the developer 13 is attracted again; however, the density detection can be performed in other regions. For instance the density detector 24 may be disposed above the magnet rotary sleeve 15 or the scraper 20 as shown in FIG. 6. In this case, when the circulation of the developer 13 is suspended by stopping the operation of the developing device, the developer 13 is dropped into the receptacle 14, as a result of which the toner is left as the residual toner 13*a* on the rotary sleeve or the scraper 20. The density of this residual toner 13*a* is detected by the detector thus disposed. In the case where, as shown in FIG. 7, the developing device is provided with a developing magnet roller 40, the residual toner 13*a* provided on the surface of the rotary sleeve 41 of the roller 40 after the developer 13 has been transferred from the roller 40 to the sleeve 15, can be detected by the density detector 24 at all times whether the roller is rotated or not.

It has been confirmed that the residual toner 13*a* proportional to the density remains on other rotary or stationary members which convey and guide or agitate the developer 13. Therefore, the residual toner may be subjected to the density detection. That is, the density detector can be provided at any position where the residual toner on the members forming the developer flow path can be detected.

The embodiment has been described with reference to the case where the technical concept of the invention is applied to the magnetic brush type developing device of the copying machine. However, it should be noted that the technical concept of the invention can be applied to other type developing devices, or to printers and facsimile devices based on the same principle and arrangement although they are different from the copying machine.

Figure 7:
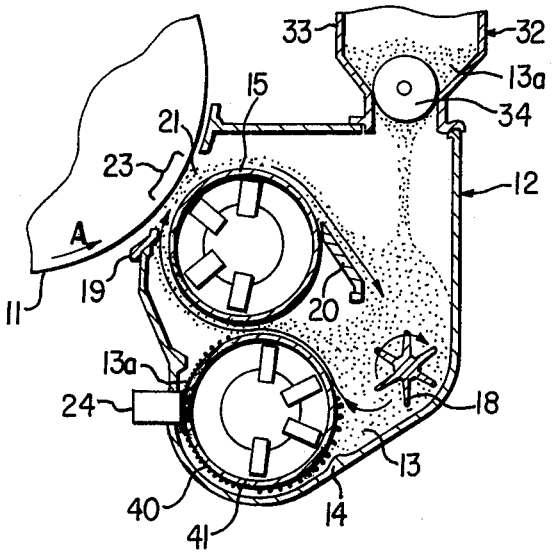

In FIGS. 6 and 7 illustrating the second and third embodiments of the invention, those components which are described with reference to FIG. 3 are similarly numbered, and therefore the detailed description of them are omitted.

As is apparent from the above description, the invention provides a toner density control device for a developing device operating to carry out development by circulating a developer made of a mixture of toner and carrier, in which the amount of toner left on the surface of conveying means is detected by the density detector to provide density information, and the toner supplying device is controlled in accordance with the density information so that the toner density is restored to a normal level.

Thus, according to the invention, the limitations in use such as the usable developers and environmental conditions, which are difficulties accompanying the convention system, are greatly eliminated, and it is unnecessary to add particular means such as for instance a probe to the original functional mechanism of the developing device. Accordingly, the toner density of the developer can be reasonably, efficiently and accurately detected. Furthermore, the toner density control device is compact, and low in manufacturing cost. The toner density control can be economically performed with excellent results.

Obviously, numerous additional modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A toner concentration control device comprising:

supplying means for supplying a fresh toner to a developing device for causing an electrostatic image on the surface of a photosensitive body to be developed with a developer comprising toner and carrier;

conveying means having a conveying surface for conveying the developer through a developing state;

detecting means for optically detecting an amount of the toner separated from the carrier of the developer and attached on the conveying surface to produce a corresponding signal; and means for controlling the supplying amount of the toner to the developing device based on said corresponding signal.

2. A device according to claim 1 wherein said conveying means comprises:

a hollow cylindrical rotary member of non-magnetic material; and a magnetic field producing structure disposed coaxially within said hollow cylindrical rotary member, said magnetic field producing structure having a magnetic field area facing the photosensitive body and a non-magnetic field area facing said detecting means.

3. A device according to claim 1 wherein said conveying means comprises:

a hollow cylindrical rotary member of non-magnetic material;

a magnetic field producing structure disposed coaxially within said hollow cylindrical rotary member; and scraping means disposed adjacent to the rotary member for scraping the developer conveyed by the rotary member.

* * * * *